US012038006B2

(12) United States Patent
Wu et al.

(10) Patent No.: US 12,038,006 B2
(45) Date of Patent: Jul. 16, 2024

(54) ELECTRIC PUMP INCLUDING A MOTOR UNIT AND AN AXIALLY EXTENDING ATTACHMENT SURFACE

(71) Applicant: NIDEC TOSOK CORPORATION, Kanagawa (JP)

(72) Inventors: Nan Wu, Kanagawa (JP); Tomohiro Sakata, Kanagawa (JP); Nguyen Thi Thanh Tam, Kanagawa (JP)

(73) Assignee: NIDEC TOSOK CORPORATION, Kanagawa (JP)

( * ) Notice: Subject to any disclaimer, the term of this patent is extended or adjusted under 35 U.S.C. 154(b) by 196 days.

(21) Appl. No.: 17/694,669

(22) Filed: Mar. 15, 2022

(65) Prior Publication Data

US 2022/0307496 A1 Sep. 29, 2022

(30) Foreign Application Priority Data

Mar. 26, 2021 (JP) ..... 2021-052841

(51) Int. Cl.

| | |
|---|---|
| ***F04C 2/10*** | (2006.01) |
| ***F04C 11/00*** | (2006.01) |
| ***F04C 15/00*** | (2006.01) |
| ***F04C 15/06*** | (2006.01) |
| *F01C 21/10* | (2006.01) |
| *F04C 2/08* | (2006.01) |

(52) U.S. Cl.

CPC ..... *F04C 2/102* (2013.01); *F04C 2/10* (2013.01); *F04C 15/06* (2013.01); *F01C 21/10* (2013.01);

(Continued)

(58) Field of Classification Search

CPC .. F04C 2/102; F04C 2/10; F04C 15/06; F04C 11/008; F04C 15/00; F04C 2240/20;

(Continued)

(56) References Cited

U.S. PATENT DOCUMENTS

2005/0163605 A1* 7/2005 Oi ..... F04D 5/002 415/55.1
2018/0254685 A1* 9/2018 Seki ..... F04C 13/001

(Continued)

FOREIGN PATENT DOCUMENTS

CN 210693704 U * 6/2020
DE 202019107293 U1 * 5/2020 ..... F01C 21/10

(Continued)

OTHER PUBLICATIONS

English Machine Translation of WO2017104843A1 via USPTO Fit Database on Nov. 3, 2023 (Year: 2017).*

(Continued)

*Primary Examiner* — Dominick L Plakkoottam
*Assistant Examiner* — Paul W Thiede
(74) *Attorney, Agent, or Firm* — HAUPTMAN HAM, LLP

(57) ABSTRACT

An electric pump includes a motor unit rotationally driving a drive shaft, and a pump unit. The pump unit includes a pump rotor that sends the fluid by a driving force of the driving shaft, and a pump housing that surrounds at least one side of the pump rotor. The pump housing includes an attachment surface extending in the axial direction and in contact with an attached body, first and second flow paths respectively on the suction side and the discharge side, and a fixing location within the attachment surface and fixed to the attached body by a fixing member within a maximum outer shape of the motor housing as viewed in the axial direction. Opening locations of the first and second flow paths are displaced from each other in the axial direction on the attachment surface.

15 Claims, 10 Drawing Sheets

(52) U.S. Cl.
CPC ..... *F04C 2/084* (2013.01); *F04C 2/086* (2013.01); *F04C 11/008* (2013.01); *F04C 15/00* (2013.01); *F04C 15/0026* (2013.01); *F04C 15/0061* (2013.01); *F04C 2240/20* (2013.01); *F04C 2240/30* (2013.01); *F04C 2240/40* (2013.01); *F04C 2240/60* (2013.01); *F04C 2250/10* (2013.01)

(58) Field of Classification Search
CPC ..... F04C 2240/30; F04C 2240/40; F04C 2240/60; F04C 2250/10; F04C 2/084; F04C 2/086; F04C 15/0026; F04C 15/0061; F01C 21/10
See application file for complete search history.

(56) References Cited

U.S. PATENT DOCUMENTS

2019/0195346 A1* 6/2019 Kobayashi ..... F01M 1/16
2019/0195349 A1* 6/2019 Kataoka ..... H02K 5/225
2022/0307499 A1* 9/2022 Wu ..... F04C 15/0026
2023/0255450 A1 8/2023 Han et al.

FOREIGN PATENT DOCUMENTS

EP 2600002 A1 * 6/2013 ..... F01C 21/007
JP 2015105601 A 6/2015
JP 2017218960 A * 12/2017
WO WO-2017104843 A1 * 6/2017 ..... F04C 14/04

OTHER PUBLICATIONS

English Machine Translation of CN210693704U via USPTO Fit Database on Nov. 2, 2023 (Year: 2020).*
English Machine Translation of JP2017-218960A via USPTO Fit Database on Nov. 2, 2023 (Year: 2017).*
English Machine Translation of DE202019107293U1 translated via USPTO Fit database (Year: 2020).*

* cited by examiner

ELECTRIC PUMP INCLUDING A MOTOR UNIT AND AN AXIALLY EXTENDING ATTACHMENT SURFACE

CROSS-REFERENCE TO RELATED APPLICATIONS

The present invention claims priority under 35 U.S.C. § 119 to Japanese Patent Application No. 2021-052841 filed on Mar. 26, 2021, the entire content of which is incorporated herein by reference.

FIELD OF THE INVENTION

The present invention relates to an electric pump.

BACKGROUND

Conventionally, an electric pump in which an attachment surface to an attached body is provided on a side in order to reduce an attachment space has been known.

For example, conventionally, a structure in which an electric pump attachment portion projecting outward is formed on one side surface in a radial direction at a bottom portion of a motor case and a plurality of attachment holes are formed in the electric pump attachment portion has been known.

However, in the conventional structure, a location of the attachment hole provided in the electric pump attachment portion projects greatly outward from the motor case, and as a result, a large space is required for attaching an oil pump.

SUMMARY

An aspect of an exemplary electric pump according to the present invention includes a motor unit that includes a drive shaft rotatably supported by a motor housing, and rotationally drives the drive shaft, and a pump unit that is positioned on one side in an axial direction along the drive shaft with respect to the motor unit, and sucks and discharges a fluid. The pump unit includes a pump rotor that sends the fluid from a suction side to a discharge side by rotating by a driving force of the driving shaft, and a pump housing that surrounds at least the one side of the pump rotor, the pump housing includes an attachment surface that extends in the axial direction and is in contact with an attached body, a first flow path and a second flow path in which the fluid flows, one flow path is on the suction side, and the other flow path is on the discharge side, and a fixing location that is within a range of the attachment surface, and is fixed to the attached body by a fixing member within a maximum outer shape of the motor housing as viewed in the axial direction, and opening locations of the first flow path and the second flow path on the attachment surface are displaced from each other in the axial direction on the attachment surface.

Another aspect of an exemplary electric pump according to the present invention includes a motor unit that includes a drive shaft, and rotationally drives the drive shaft, and a pump unit that is positioned on one side in an axial direction along the drive shaft with respect to the motor unit, and sucks and discharges a fluid. The pump unit includes a pump rotor that sends the fluid from a suction side to a discharge side by rotating by a driving force of the drive shaft, and a pump housing that surrounds at least the one side of the pump rotor, the pump housing includes an attachment surface that extends in the axial direction, and is in contact with an attached body, a first flow path and a second flow path in which the fluid flows, one flow path is on the suction side, and the other flow path is on the discharge side, and a fixing location that is fixed to the attached body by a fixing member within a range of the attachment surface, and all opening locations of the first flow path and the second flow path and the fixing location on the attachment surface are positioned on one side with respect to the drive shaft as viewed from the attachment surface side.

The above and other elements, features, steps, characteristics and advantages of the present disclosure will become more apparent from the following detailed description of the preferred embodiments with reference to the attached drawings.

DETAILED DESCRIPTION

Hereinafter, the present disclosure and an embodiment of an electric pump will be described in detail with reference to the accompanying drawings. However, in order to avoid the following description from being unnecessarily redundant and to make it easier for those skilled in the art to understand, a detailed description more than necessary may be omitted. For example, detailed descriptions of well-known matters and duplicate description of substantially the same configuration may be omitted. Elements described in the figure described earlier may be appropriately referred to in the description of the later figure.

Figure 1:
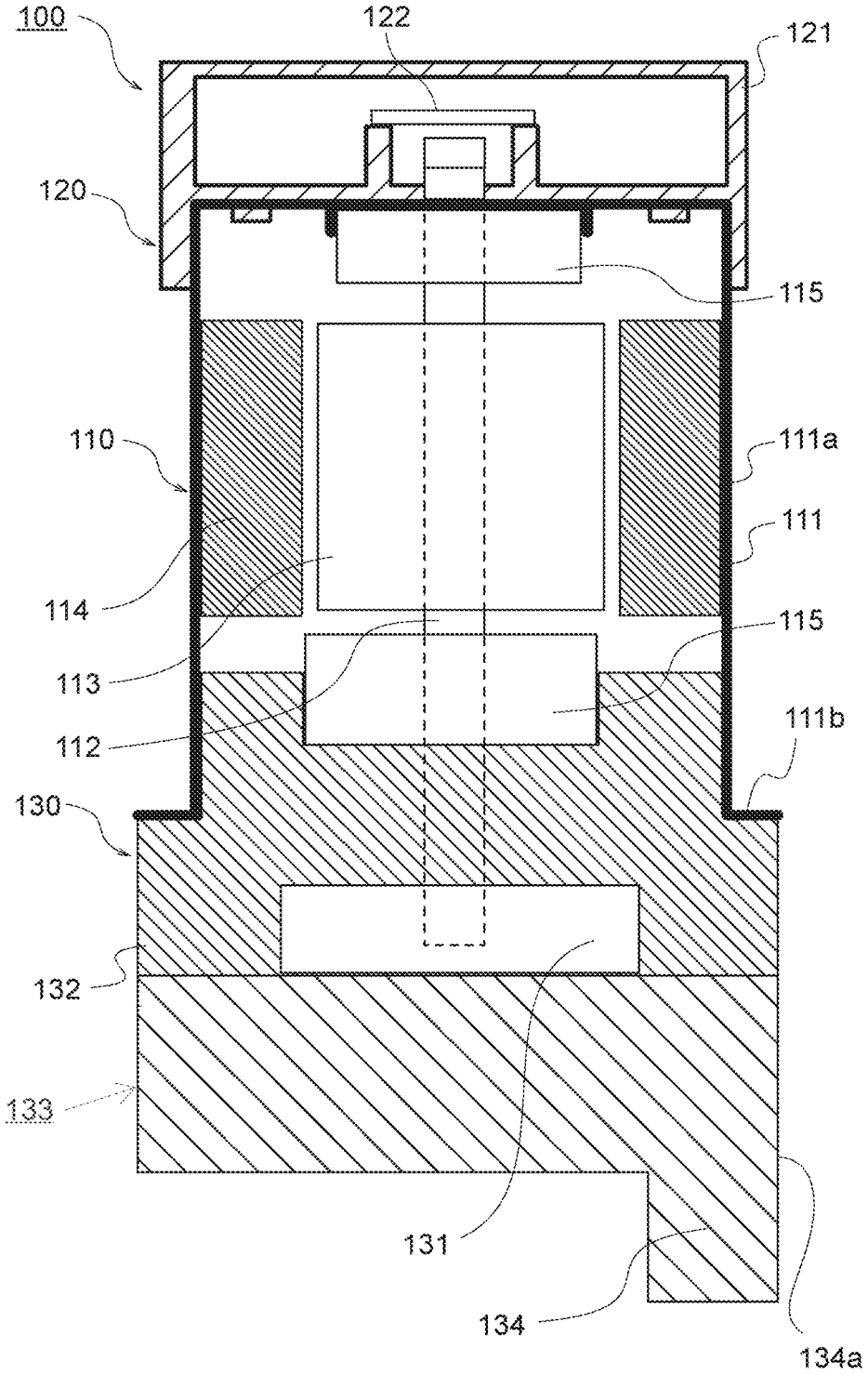
FIG. 1 is a diagram conceptually illustrating a structure of an oil pump.

FIG. 1 is a diagram conceptually illustrating a structure of an oil pump.

An oil pump 100 corresponds to an embodiment of the electric pump according to the present invention.

The oil pump 100 includes a motor unit 110, a sensor unit 120, and a pump unit 130.

The motor unit 110 receives electric power to generate rotational driving force.

The sensor unit 120 detects the rotation of the motor unit 110.

The pump unit 130 is driven by the motor unit 110 to suck and discharge oil.

The pump unit 130 corresponds to an example of a pump unit according to the present invention.

The motor unit 110 includes a motor housing 111, a drive shaft 112, a rotor 113, a stator 114, and bearings 115.

The drive shaft 112 is a member that transmits the rotational driving force of the motor unit 110, and is rotatably supported by the motor housing 111 via the bearings 115. That is, the motor unit 110 has the drive shaft 112 rotatably supported by the motor housing 111, and rotationally drives the drive shaft 112.

In the following description, the drive shaft 112 is used as a reference for a direction, and a direction along the drive shaft 112 may be referred to as an axial direction. In the following description, regardless of the illustrated direction, a lower side in FIG. 1 may be referred to as one side in the axial direction (i.e., a first side of oil pump 100), and an upper side in FIG. 1 may be referred to as the other side in the axial direction (i.e., a second side of oil pump 100). In the following description, a direction in which the drive shaft 112 deviates perpendicularly to a rotation center line is referred to as a radial direction, a direction closer to the drive shaft 112 may be referred to as an inside in the radial direction, and a direction far from the drive shaft 112 may be referred to as an outside in the radial direction.

The motor housing 111 is a structure that supports the entire motor unit 110 and the oil pump 100, and is formed by, for example, pressing sheet metal. The motor housing 111 has a tubular portion 111*a* extending in a tubular shape in the axial direction and a flange portion 111*b* extending outward from one end of the tubular portion 111*a* on one side in the axial direction, and the motor housing 111 has a maximum outer shape at an outer edge of the flange portion 111*b*. The motor housing 111 accommodates therein the rotor 113 and the stator 114.

The rotor 113 is fixed to the drive shaft 112, for example, has an incorporated permanent magnet, and rotates together with the drive shaft 112 by an action of a rotating magnetic field.

The stator 114 is accommodated in the motor housing 111 so as to face the rotor 113 to generate a rotating magnetic field. In the present embodiment, although an inner rotor type structure in which the stator 114 is disposed on an outside the rotor 113 in the radial direction is illustrated, the motor according to the present invention may have an outer rotor type structure in which the stator 114 is disposed on the inside of the rotor 113 in the radial direction.

The bearing 115 is, for example, a ball bearing and rotatably supports the drive shaft 112. The bearing 115 may be a roller bearing, a sliding bearing, or the like. The bearings 115 are arranged on one side in the axial direction and the other side in the axial direction with the rotor 113 interposed therebetween, the bearing 115 on the other side in the axial direction is fixed to the motor housing 111, and the bearing 115 on one side in the axial direction is held by, for example, the pump unit 130.

The sensor unit 120 includes a board case 121, and an end portion of a conducting wire drawn from a coil of the stator 114 is guided to the board case 121. In the present embodiment, the board case 121 is used as a wiring lead-out space for the motor unit 110. The board case 121 accommodates therein and holds, for example, the sensor board 122. The sensor board 122 has a magnetic sensor, and detects, for example, a rotation position and a rotation speed of the drive shaft 112. The board case 121 may accommodate a control board or an inverter board together with the sensor board 122 or in place of the sensor board 122. The electric pump according to the present invention may not have the sensor unit 120.

The pump unit 130 includes a pump rotor 131, a pump body 132, and a pump cover 133. The pump unit 130 is disposed on one side of the motor housing 111 in the axial direction. In other words, the pump unit 130 is positioned on one side of the motor unit 110 in the axial direction along the drive shaft 112, and sucks and discharges a fluid (oil as an example). In the present embodiment, although the fluid is assumed to be oil, the following description is established for general fluids.

The pump rotor 131 sends oil from the suction side to the discharge side by rotating by the driving force of the drive shaft 112.

Figure 2:
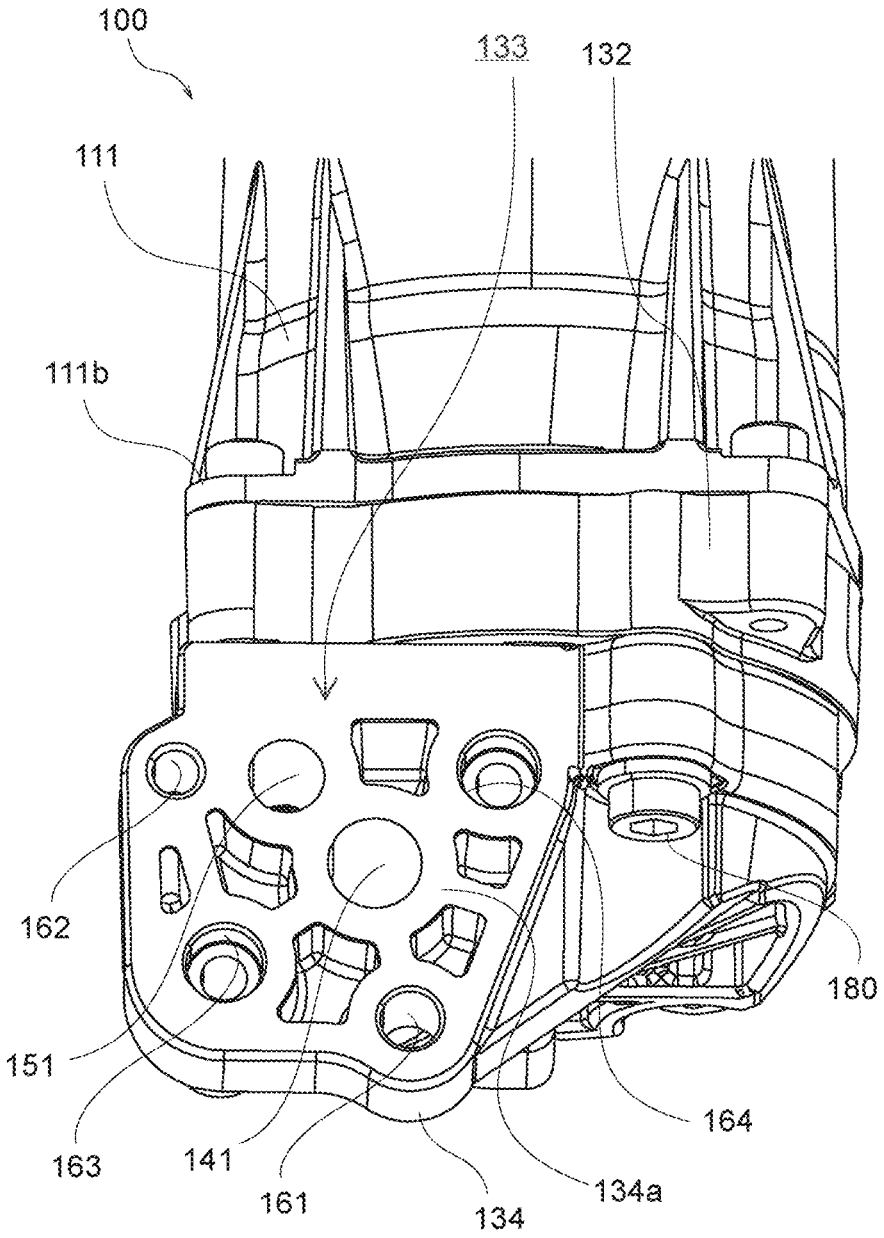
FIG. 2 is a perspective view illustrating an appearance of a pump unit.
Figure 3:
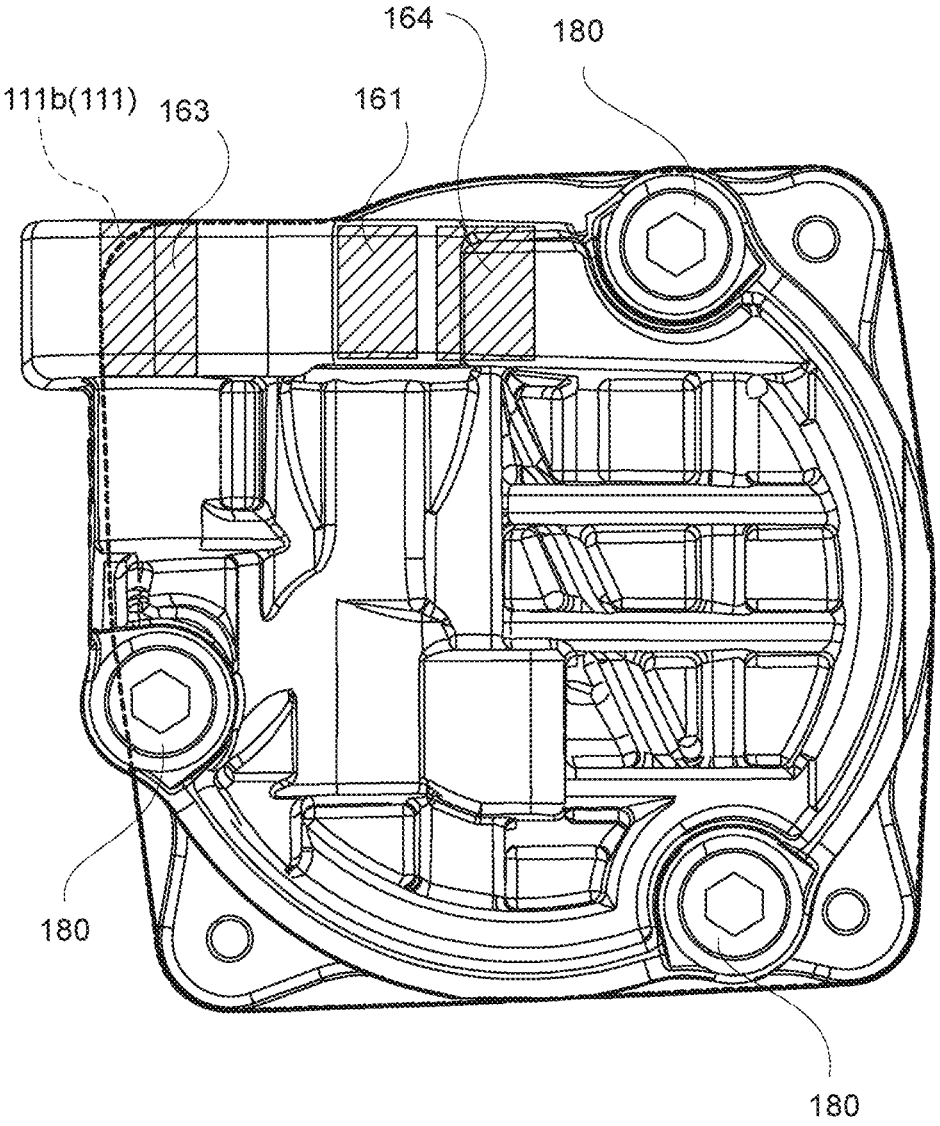
FIG. 3 is a diagram illustrating an appearance of the pump unit viewed from one side in an axial direction.

FIG. 2 is a perspective view illustrating an appearance of the pump unit 130, and FIG. 3 is a diagram illustrating an appearance of the pump unit 130 as seen from one side in the axial direction.

The pump body 132 accommodates the pump rotor 131 and is fixed to the motor housing 111. In the present embodiment, the pump body 132 has an accommodation space for the pump rotor 131, and the pump cover 133 is a lid that covers the accommodation space and one side of the pump rotor 131 in the axial direction.

The pump cover 133 corresponds to an example of a pump housing according to the present invention that covers at least one side of the pump rotor 131 in the axial direction.

In the present embodiment, although the motor housing 111, the pump body 132, and the pump cover 133 are separate members, in the electric pump according to the present invention, the pump body 132 may be integrated with the motor housing 111, or the pump body 132 may be integrated with the pump cover 133. When the pump body 132 is integrated with the motor housing 111, the pump body corresponds to an example of a motor housing according to the present invention, and when the pump body 132 is integrated with the pump cover 133, the pump body corresponds to an example of a pump housing according to the present invention.

The pump cover 133 is coupled to the pump body 132 by being screwed to the pump body 132 with a plurality of bolts 180. The bolt 180 corresponds to an example of a coupling member according to the present invention. In addition to the bolt, a press-fit pin, a rivet, or the like can be used as the coupling member according to the present invention.

The pump cover 133 has a plate-shaped attachment plate portion 134 for attaching the oil pump 100 on an attached body to which the oil pump 100 is attached, for example, an oil pan of an automobile. The attachment plate portion 134 has an attachment surface 134*a* that extends in the axial direction, and the oil pump 100 is fixed to the attached body by a fixing member in a state where the attachment surface 134*a* is in contact with the attached body. That is, the pump cover 133 has the attachment surface 134*a* that extends in the axial direction and is in contact with the attached body. The pump cover 133 includes the attachment plate portion 134 having the attachment surface 134*a* that protrudes in a plate shape toward one side in the axial direction. For example, bolts, press-fit pins, rivets, and the like can be used as the fixing member. In the present embodiment, bolts are used as the fixing member in consideration of easiness of disassembly and the like.

The pump cover 133 has a first flow path 140 (see FIG. 6) and a second flow path 150 (see FIG. 6) in which oil flows, one flow path is on the suction side and the other flow path is on the discharge side, and openings 141 and 151 of the first flow path 140 and the second flow path 150 are present on the attachment surface 134*a*. Positions of the openings 141 and 151 are different from each other in the axial direction (upper-lower direction in FIG. 2).

In the present embodiment, since the oil is sucked from the first flow path 140 side and is discharged to the second flow path 150 side, in the following description, the first flow path 140 may be referred to as a suction path 140, and the second flow path 150 may be referred to as a discharge path 150. When the opening 141 of the first flow path (suction path) 140 on the attachment surface 134*a* may be referred to as a suction opening 141, and the opening 151 of the second flow path (discharge path) 150 on the attachment surface 134*a* may be referred to as a discharge opening 151.

On the attachment surface 134*a*, a plurality of fixing locations 161, 162, 163, and 164 (for example, four locations) which are fixed to the attached body are provided by bolts, which is an example of the fixing member. Among the four fixing locations 161, . . . , and 164, the three fixing locations 161, 163, and 164 except for the second fixing location 162 are positioned in a range of the flange portion 111*b* of the motor housing 111 as viewed in the axial direction, as illustrated in FIG. 3.

In the present embodiment, the pump cover 133 includes the fixing locations 161, 163, and 164 fixed to the attached body by the fixing members within the range of the attachment surface 134*a* and within a maximum outer shape of the motor housing 111 as viewed in the axial direction. The locations of the openings 141 and 151 on the attachment surfaces 134*a* of the first flow path 140 and the second flow path 150 are displaced from each other on the attachment surface 134*a* in the axial direction. The locations of the openings (that is, the suction opening 141 and the discharge opening) are displaced in the axial direction, and thus, the entire size of the first flow path 140 and the second flow path 150 is suppressed in the radial direction. The fixing locations 161, 163, and 164 fit within the maximum outer shape of the motor housing 111, and thus, an increase in size of the attachment plate portion 134 is suppressed.

In the present embodiment, the locations of the suction opening 141 and the discharge opening 151 on the attachment surface 134*a* are displaced from each other on the attachment surface 134*a* in a direction intersecting the axial direction (left-right direction in the figure). As a result, since the suction opening 141 and the discharge opening 151 can be brought close to each other in both the radial direction and the axial direction, the entire size of the suction path 140 and the discharge path 150 is suppressed in both the radial direction and the axial direction, and the increase in size of the attachment plate portion 134 is suppressed in both the axial direction and the radial direction.

Among the four fixing locations 161, . . . , and 164, the first fixing location 161 is a through-hole which the bolt penetrates from a back side to a front side (that is, from the oil pump 100 side to the attached body side) in FIG. 2, and the second fixing location 162 is a female screw hole penetrating the attachment plate portion 134 into which the bolt is twisted from the front side to the back side (that is, from the attached body side to the oil pump 100 side) in FIG. 2.

The third and fourth fixing locations 163 and 164 are bottomed holes that are recessed from the attachment surface 134*a* side and have a bottom, and are stepped holes that have a wide opening side and a narrow back side, and narrow portions 163*b* and 164*b* on the back side are female screw holes.

An inner wall (including a cylindrical portion and a bottom portion) is in contact with a ring-shaped positioning protrusion provided on the attached body, and thus, wide portions 163*a* and 164*a* on the opening side of the third and fourth fixing locations 163 and 164 are used for positioning. That is, the third and fourth fixing locations 163 and 164 are stepped holes that are opened to the attachment surface 134*a* and have the back side having an inner diameter smaller than an inner diameter of the opening side, and the opening sides 163*a* and 164*a* of the stepped holes are in contact with the positioning protrusions of the attached body, and the back sides 163*b* and 164*b* of the stepped holes are in contact with the fixing members. Thus, since positioning and fixing are integrated into one fixing location, the increase in size of the attachment plate portion 134 is further suppressed. The contact with the positioning protrusions on the opening sides 163*a* and 164*a* may be the contact of only one of the cylindrical portion and the bottom portion of the inner wall.

At least one of the fixing locations 161, . . . , and 164 fits within the maximum outer shape of the motor housing 111, and thus, the increase in size of the attachment plate portion 134 is suppressed. However, all the other fixing locations 161, 163, and 164 except for one exceptional fixing location 162 among the four fixing locations 161, . . . , and 164 fit within the maximum outer shape of the motor housing 111, and thus, the increase in size of the attachment plate portion 134 can be further suppressed. When the fixing location 161 of the through-hole fits within the maximum outer shape of the motor housing 111, a space for causing the fixing member (bolt) to enter the fixing location 161 from the oil pump 100 side also fits within the maximum outer shape of the motor housing 111, and thus, it is effective in suppressing the increase in size. When both the fixing location 161 of the through-hole and the fixing locations 162, 163, and 164 having the female screw hole are present in the maximum outer shape of the motor housing 111 at least one by one, since the fixing locations are firmly fixed by the fixing members (bolts) from both the oil pump 100 side and the attached body side, both the suppression of the increase in size and the improvement of fixing strength are realized.

Figure 4:
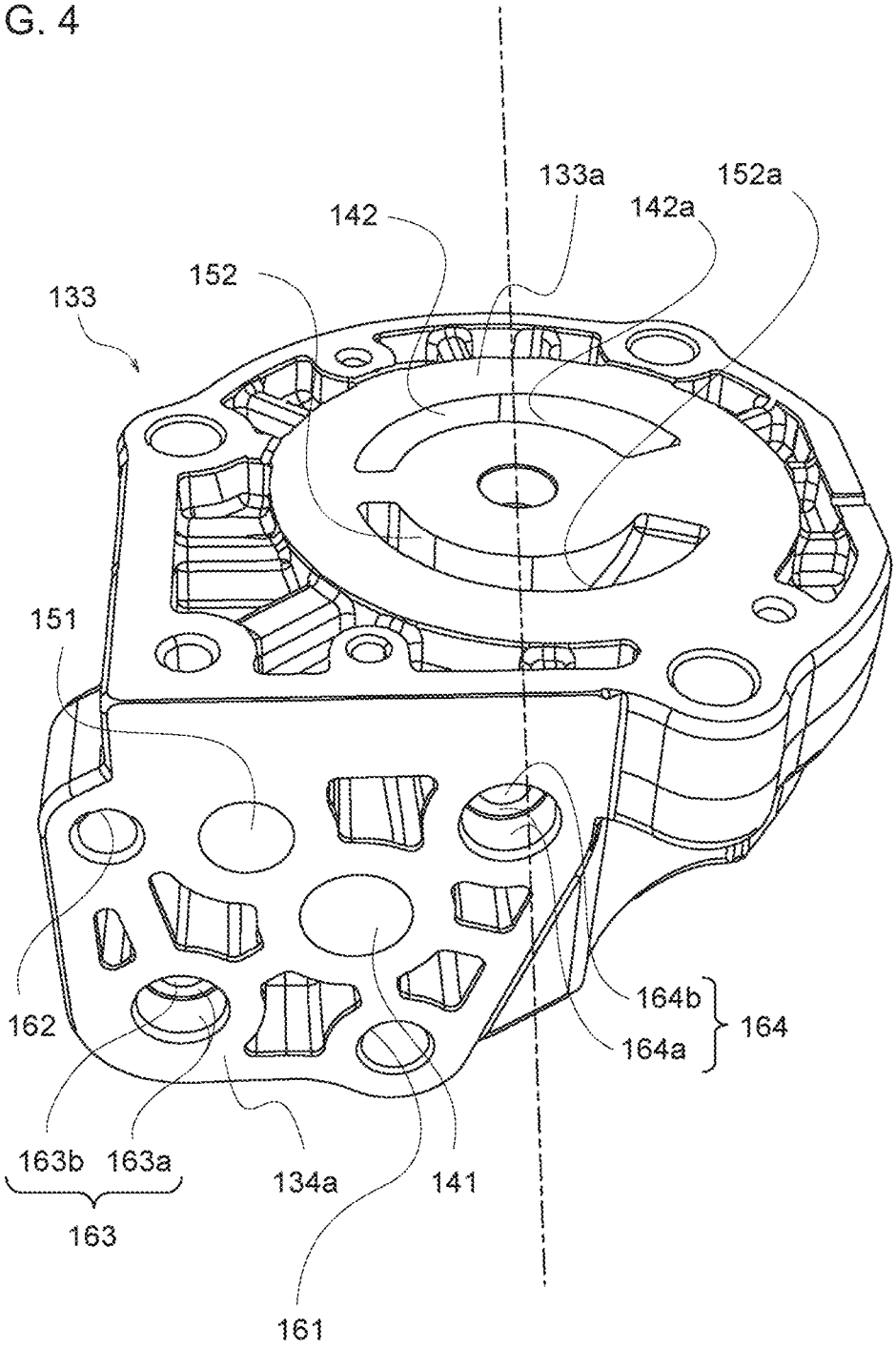
FIG. 4 is a perspective view illustrating an external structure of a pump cover.

FIG. 4 is a perspective view illustrating an external structure of the pump cover 133.

FIG. 4 illustrates the attachment surface 134*a* of the attachment plate portion 134, as well as the cover surface 133*a* covering the pump body 132 and the pump rotor 131.

An opening 142*a* of the suction path 140 and an opening 152*a* of the discharge path 150 are provided in the cover surface 133*a* of the pump cover 133, and each of the openings 142*a* and 152*a* is an arc-shaped opening extending in the circumferential direction around the drive shaft 112. A suction port 142 and a discharge port 152 recessed from the openings 142*a* and 152*a* on the cover surface 133*a* to one side in the axial direction are provided in the pump cover 133.

In FIG. 4, a center line of the drive shaft 112 is indicated by a dashed dotted line, and the suction opening 141, the discharge opening 151, and the four fixing locations 161, . . . , and 164 provided on the attachment surface 134*a* of the attachment plate portion 134 are positioned on a left side of the figure with respect to the center line of the drive shaft 112 indicated by the dashed dotted line. That is, all the openings 141 and 151 of the first flow path 140 and the second flow path 150 and the fixing locations 161, 162, 163, and 164 on the attachment surface 134*a* are positioned on one side of the drive shaft 112 as viewed from the attachment surface 134*a* side. According to the arrangement closer to one side in this manner, the increase in size of the attachment plate portion 134 having the attachment surface 134*a* is suppressed.

Here, an operation of the pump unit 130 will be described.

Figure 5:
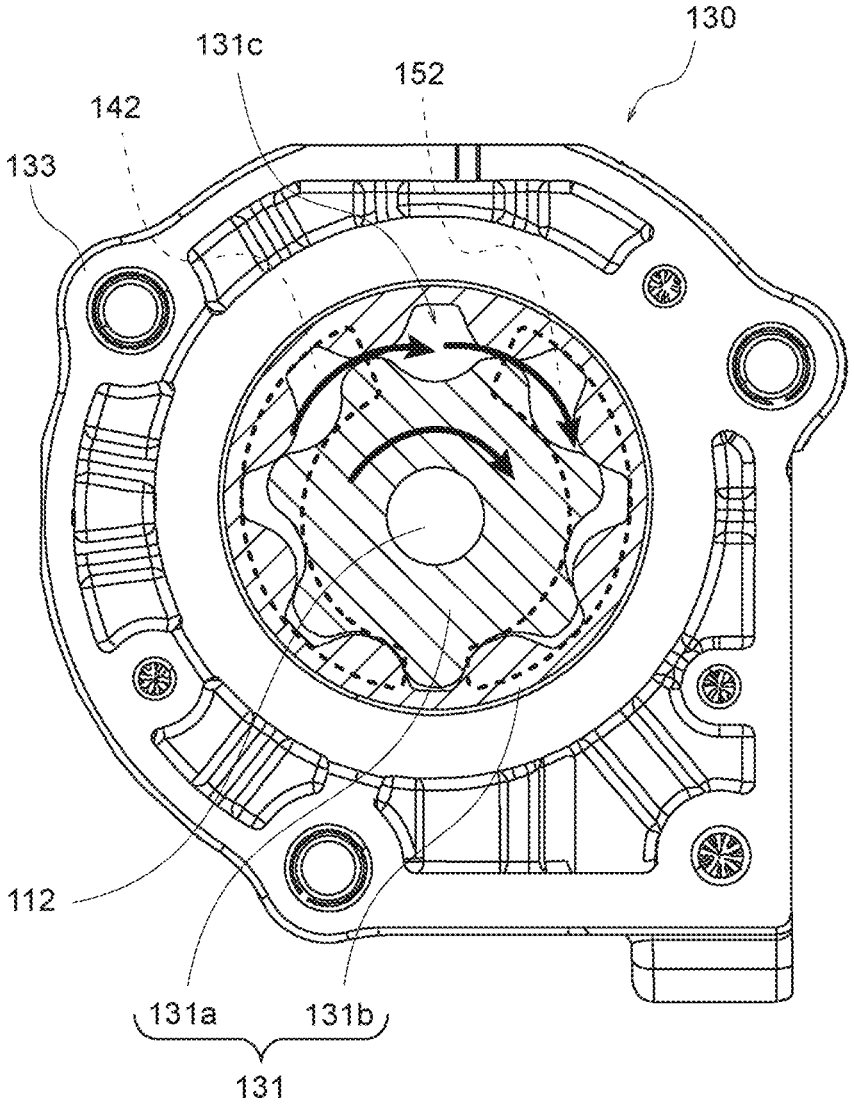
FIG. 5 is a diagram for describing an operation of the pump unit.

FIG. 5 is a diagram for describing an operation of the pump unit 130.

The pump rotor 131 of the pump unit 130 has an inner rotor 131*a* fixed to the drive shaft 112 and an outer rotor 131*b* that meshes with the inner rotor 131*a*.

The suction port 142 and the discharge port 152 provided in the pump cover 133 are opened toward the pump rotor 131 side.

When the inner rotor 131*a* is rotationally driven together with the drive shaft 112, the outer rotor 131*b* rotates around a rotation center at a position different from a rotation center of the inner rotor 131*a*. Since the positions of the rotation centers are different between the inner rotor 131*a* and the outer rotor 131*b*, a room (space) 131*c* in which oil enters is generated between the inner rotor 131*a* and the outer rotor 131*b*. The oil room 131*c* moves with the rotation of the pump rotor 131. For example, in the case of the clockwise rotation illustrated in FIG. 5, the oil room 131*c* also moves clockwise. As a result, the oil is sent from the suction port 142 side to the discharge port 152 side, and oil suction and discharge are realized.

The rotational driving of the drive shaft 112 is counter-clockwise opposite to the direction in FIG. 5, and thus, the oil suction and discharge are also in the opposite directions. However, for the sake of convenience in description, the drive shaft 112 and the pump rotor 131 are rotationally driven clockwise as illustrated in FIG. 5.

Figure 6:
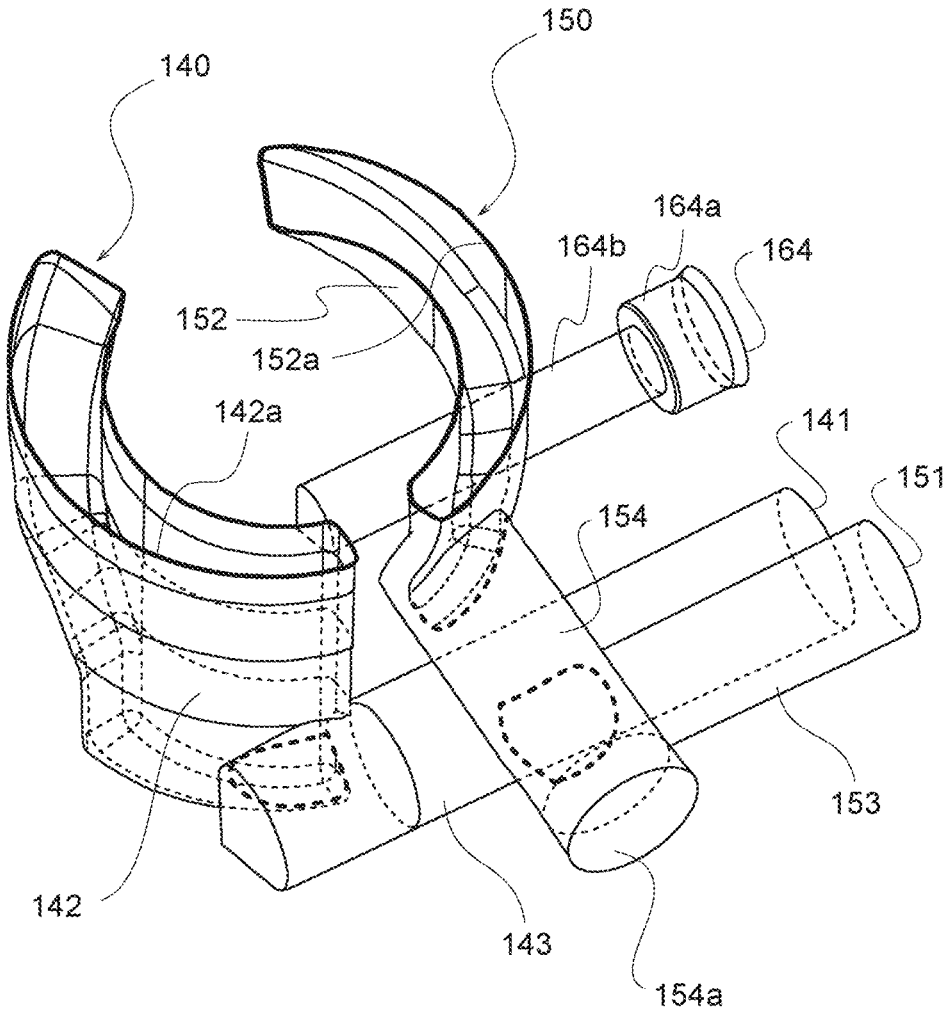
FIG. 6 is a structural diagram illustrating a structure of a suction path and a discharge path provided inside the pump cover.

FIG. 6 is a structural diagram illustrating a structure of the suction path 140 and the discharge path 150 provided inside the pump cover 133.

The suction path 140 has the suction opening 141 and the suction port 142 described above. The suction path 140 has the extension portion 143 extending from the suction opening 141 in a direction intersecting with the attachment surface 134*a* and connected to the suction port 142.

The suction port 142 is recessed from the opening 142*a* facing the pump rotor 131 to one side in the axial direction, and the bottom on the one side in the axial direction is narrower than a width of the opening 142*a*. The suction port 142 is bent and extends in an arc shape as a whole, and one end 142*b* having an arc shape is connected to the extension portion 143.

The discharge path 150 has the discharge opening 151 and the discharge port 152 described above. The discharge path 150 includes an attachment-side extension portion 153 extending from the discharge opening 151 in the direction intersecting the attachment surface 134*a*, and a pump-side extension portion 154 from the discharge port 152 in the direction intersecting the axial direction and extending to a direction along the attachment surface 134*a*.

The attachment-side extension portion 153 and the pump-side extension portion 154 are connected, but (the center line of) the attachment-side extension portion 153 and (the center line of) the pump-side extension portion 154 are at twisted positions that are displaced in the axial direction. An end portion 154*a* of the pump-side extension portion 154 opposite to the discharge port 152 is closed with a cap member (not illustrated).

The discharge port 152 is recessed from the opening 152*a* facing the pump rotor 131 to one side in the axial direction, and the bottom on one side in the axial direction is narrower than a width of the opening 152*a*. The bottom of the discharge port 152 is positioned on the other side in the axial direction as compared with the bottom of the suction port 142, and a depth of the suction port 142 from the opening 142*a* to the bottom is deeper than a depth of the discharge port 152 from the opening 152*a* to the bottom.

A combination of the pump rotor 131 illustrated in FIG. 5, the accommodation space of the pump rotor 131, and the suction path 140 and the discharge path 150 illustrated in FIG. 6 is a functional portion having a function of the pump unit 130.

Among the four fixing locations provided on the attachment surface 134*a* described above, the fourth fixing location 164 is a bottomed recess portion opened on the attachment surface 134*a* side, and the suction port 142 included in the functional portion of the pump unit 130 is present at an extended end of the recess portion to the bottom side. Since the fixing location can be fixed by the fixing member even at a location overlapping the functional portion of the pump unit 130 as viewed from the attachment surface side by providing the fourth fixing location 164 at such a position, the increase in size of the attachment plate portion 134 can be further suppressed.

As described above, in the present embodiment, although the increase in size of the attachment plate portion 134 is suppressed, since the attachment plate portion 134 has a structure in which the attachment plate portion protrudes in a plate shape toward one side in the axial direction, vibrations that accompany the driving of the motor unit 110 and the pump unit 130 are likely to occur, and thus, a structure that suppresses noise and damage is required.

Figure 7:
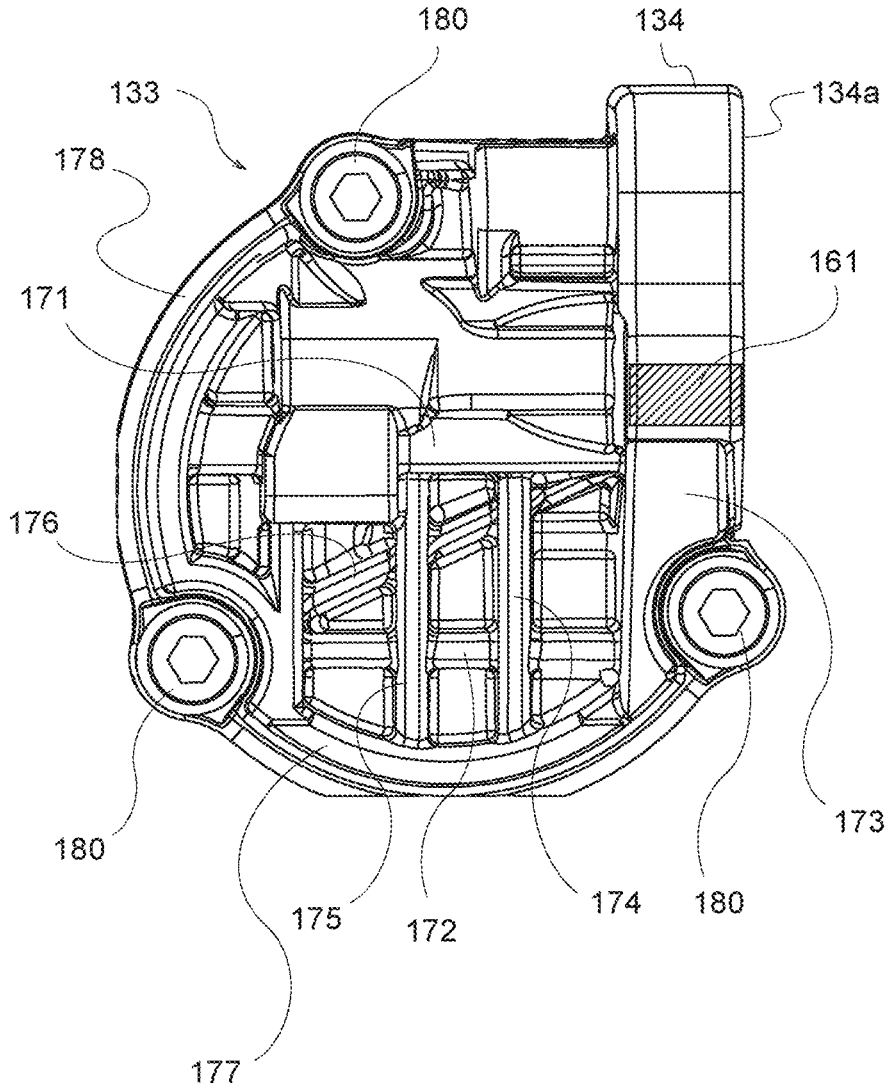
FIG. 7 is a diagram illustrating the pump cover viewed from one side in the axial direction.
Figure 8:
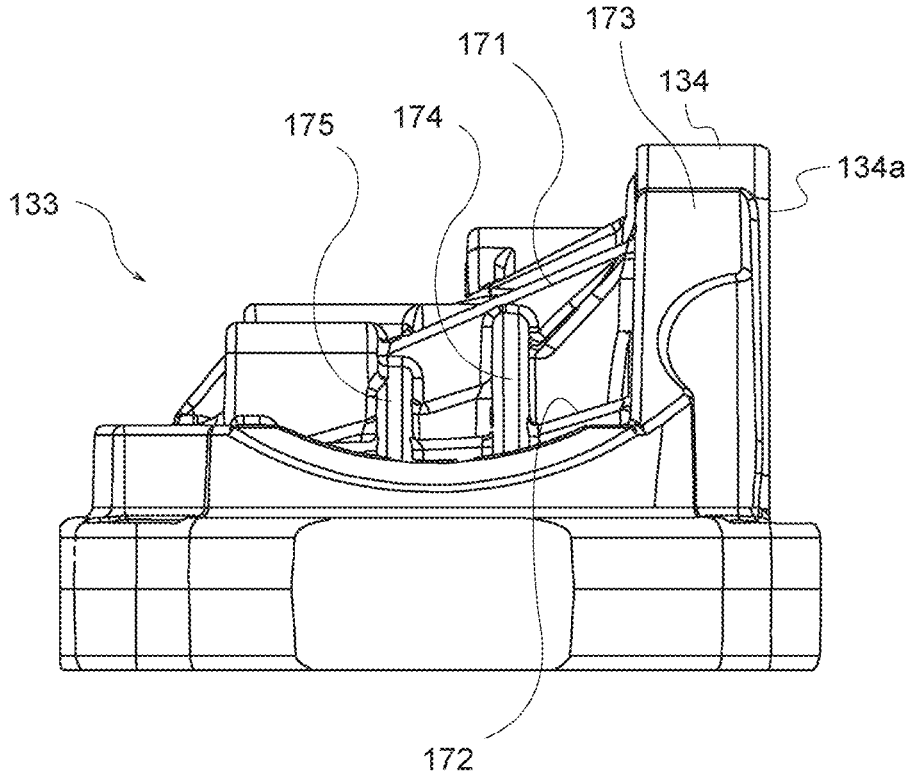
FIG. 8 is a diagram illustrating the pump cover viewed from a direction perpendicular to the axial direction and parallel to an attachment surface.
Figure 9:
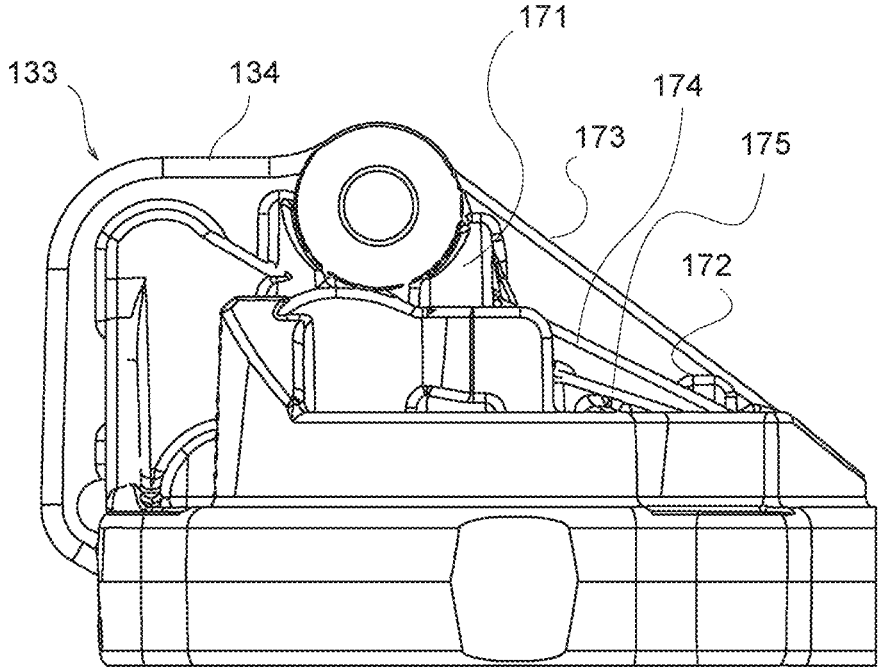
FIG. 9 is a diagram illustrating the pump cover viewed from a direction perpendicular to both the axial direction and the attachment surface.
Figure 10:
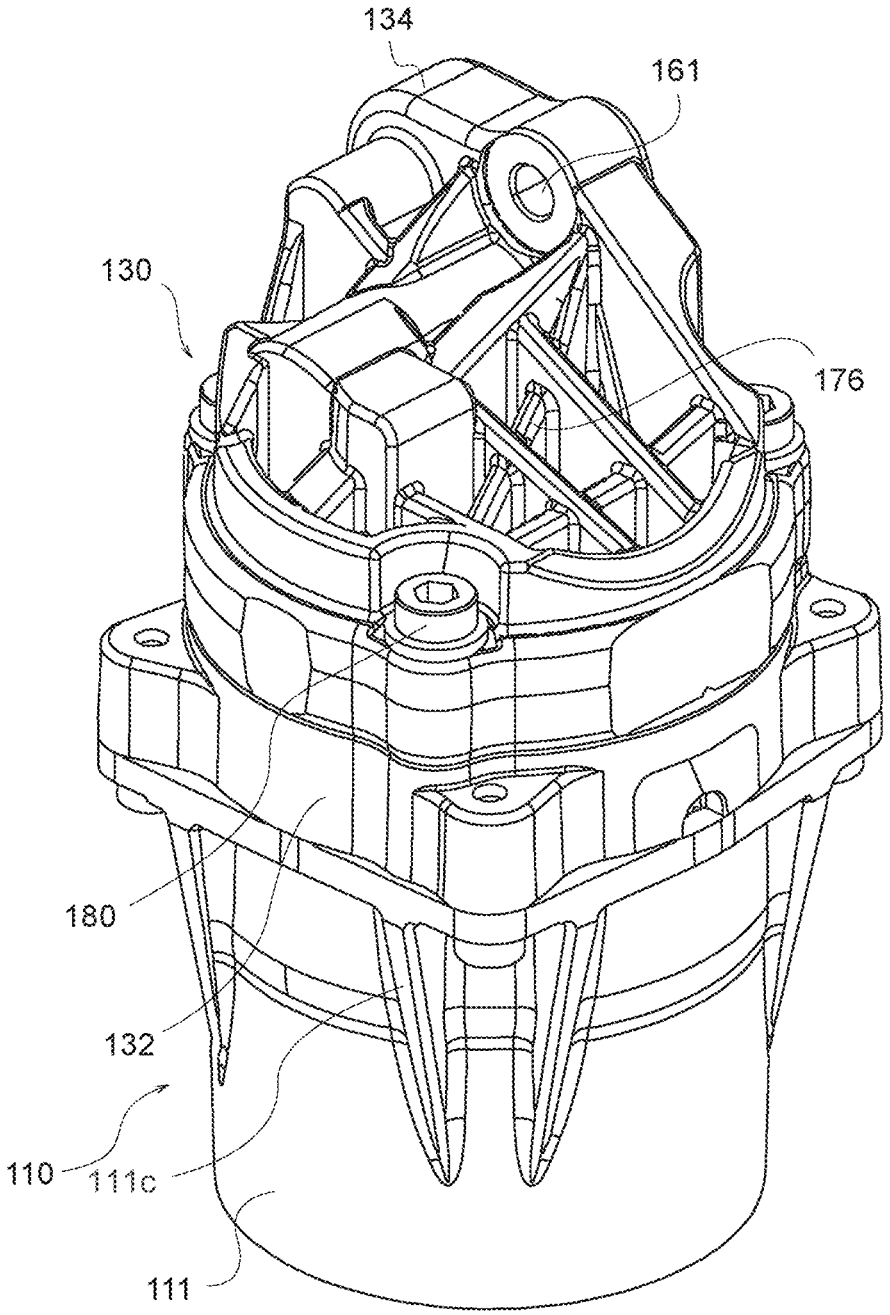
FIG. 10 is a perspective view illustrating an appearance of a pump unit 130 and a motor unit 110 viewed from a side opposite to an attachment plate portion 134.

FIG. 7 is a diagram illustrating the pump cover 133 viewed from one side in the axial direction, FIG. 8 is a diagram illustrating the pump cover 133 viewed from a direction perpendicular to the axial direction and parallel to the attachment surface 134*a*, and FIG. 9 is a diagram illustrating the pump cover 133 viewed from a direction perpendicular to both the axial direction and the attachment surface 134*a*. FIG. 10 is a perspective view illustrating appearances of the pump unit 130 and the motor unit 110 viewed from a side opposite to the attachment plate portion 134.

A plurality of types of ribs are combined and formed on one side of the pump cover 133 in the axial direction, and the rigidity of the pump cover 133 is increased by these ribs. Each rib protrudes in a plate shape to one side in the axial direction and extends along a paper surface of FIG. 7. Specifically, orthogonal ribs 171 and 172 extending perpendicular to the attachment surface 134*a*, parallel ribs 173, 174, and 175 extending parallel to the attachment surface 134*a*, an oblique rib 176 extending diagonally with respect to the attachment surface 134*a*, and arc-shaped ribs 177 and 178 extending in an arc shape are provided.

In other words, the pump cover 133 includes the orthogonal ribs 171 and 172 that protrude in the plate shape to one side in the axial direction and extend in a direction (for example, an orthogonal direction) that intersects the attachment surface 134*a*. The rigidity of the pump housing is improved by the orthogonal ribs 171 and 172, and the vibration is suppressed.

The pump cover 133 includes the parallel ribs 173, 174, and 175 that protrude in the plate shape to one side in the axial direction and extend in a direction (as an example, a parallel direction) along the attachment surface 134*a*. The rigidity of the pump cover 133 is also improved by the parallel ribs, and the vibration is suppressed.

The pump cover 133 includes the oblique rib 176 that protrudes in the plate shape to one side in the axial direction and extends in a direction connecting the bolts 180 which are the coupling members and the fixing locations 161 and 164. The rigidity of the pump cover 133 is improved by the oblique rib 176, and the vibration is suppressed. The bolts 180 which are the coupling members can also be effectively used as parts (extension) of the ribs.

The oblique rib 176 is provided, and thus, as illustrated in FIG. 10, a structure extending from the fixing location 161 of the attachment plate portion 134 to the rib 111*c* of the motor housing 111 via the oblique rib 176, the bolts 180, and the pump body 132 is formed. The rigidity from the pump cover 133 to the motor housing 111 is improved by this structure. Since this structure extends in the direction intersecting the attachment surface 134*a* and passes through the bolt 180 farthest from the attachment plate portion 134 among the plurality of bolts 180, the pump cover 133, the pump body 132, and the motor housing 111 are integrated with the attachment plate portion 134, and thus, the rigidity is further improved.

The pump cover 133 includes the arc-shaped ribs 177 and 178 that protrude in the plate shape to one side in the axial direction and extend in the circumferential direction around the drive shaft 112 and in the direction of connecting the bolts 180 that are the coupling members. The rigidity of the pump housing is improved by the arc-shaped ribs, and the vibration is suppressed. The bolts 180 which are the coupling members can be effectively used as the parts (extension) of the ribs.

It is desirable that the pump cover 133 has the plurality of types of ribs among the orthogonal ribs 171 and 172, the parallel ribs 173, 174, and 175, the oblique rib 176, and the arc-shaped ribs 177 and 178 since the rigidity is synergistically improved.

The first orthogonal rib 171 extends from the attachment plate portion 134 to directly support the attachment plate portion 134, and the rigidity of the pump cover 133 is improved. The second orthogonal rib 172 protrudes in the plate shape to one side in the axial direction and extends in the direction connecting the bolts 180 which are the coupling members. The rigidity of the pump cover 133 is improved by the second orthogonal rib 172, and the vibration is suppressed. The bolts 180 which are the coupling members can also be effectively used as parts (extension) of the ribs.

Ridges of the orthogonal ribs 171 and 172 are inclined diagonally as illustrated in FIG. 8, and heights of the orthogonal ribs 171 and 172 are higher on the attachment plate portion 134 side (right side in FIG. 8) than on the opposite side. As a result, it is possible to suppress the increase in size while improving the rigidity. As compared with heights of the parallel ribs 173, 174, and 175, the attachment plate portion 134 side (right side in FIG. 8) is higher than the opposite side (left side in FIG. 8). Accordingly, it is possible to suppress the increase in size while improving the rigidity.

The first parallel rib 173 extends from the attachment plate portion 134 in the direction along the attachment surface 134*a*. The first parallel rib 173 extends toward the bolt 180 which is the coupling member. Apart of the first parallel rib 173 surrounds the bolt 180. The rigidity of the pump cover 133 is increased by such a first parallel rib 173, and the bolt 180 is effectively used as the part (extension) of the rib.

As illustrated in FIG. 9, the ridges of the parallel ribs 173, 174, and 175 are inclined diagonally, and the attachment plate portion 134 side (left side in FIG. 9) is higher than the opposite side. As a result, it is possible to suppress the increase in size while improving the rigidity.

Here, the oil pump is used as an example of the method of using the electric pump according to the present invention, but the method of using the electric pump according to the present invention is not limited to the above example. The electric pump according to the present invention can also be used as a pump that sucks and discharges water, air, and the like.

Although the motor housing formed by press working is illustrated above, the motor housing according to the present invention may be formed by die casting or injection molding.

It is to be considered that the embodiment described above is illustrative in all aspects, and are not restrictive. The scope of the present invention is illustrated not by the above-described embodiment but by the scope of the claims, and is intended to include all changes within the meaning and scope equivalent to the scope of claims.

Features of the above-described preferred embodiments and the modifications thereof may be combined appropriately as long as no conflict arises.

While preferred embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. An electric pump comprising:

a motor unit that includes a drive shaft rotatably supported by a motor housing, and configured to rotationally drive the drive shaft; and a pump unit that is positioned on a first side in an axial direction along the drive shaft with respect to the motor unit, and configured to suck and discharge a fluid, wherein the pump unit includes a pump rotor configured to send the fluid from a suction side to a discharge side by rotating by a driving force of the drive shaft, and a pump cover disposed at an outer end of the first side in the axial direction so as to cover the pump rotor, the pump cover includes an attachment surface that extends in the axial direction, a first flow path and a second flow path in which the fluid flows, one flow path is on the suction side and the other flow path is on the discharge side, and a fixing location on the attachment surface is within a range of a flange portion of the motor housing as viewed in the axial direction, the fixing location being engaged with a fixing member within a maximum outer shape of the motor housing as viewed in the axial direction, and opening locations of the first flow path and the second flow path on the attachment surface are displaced from each other in the axial direction on the attachment surface.

2. The electric pump according to claim 1, wherein the fixing location is a bottomed recess portion that is opened to the attachment surface, and the bottomed recess portion extends toward the pump rotor of the pump unit.

3. The electric pump according to claim 1, wherein the fixing location is a stepped hole that is opened to the attachment surface and has a back side having an inner diameter smaller than an inner diameter on an opening side, and the back side of the stepped hole is in contact with the fixing member.

4. The electric pump according to claim 1, wherein the pump cover further includes an attachment plate portion that protrudes in a plate shape toward the first side in the axial direction, wherein the attachment plate portion includes the attachment surface, and a first rib that protrudes in a plate shape from the attachment plate portion in a direction intersecting with the attachment surface.

5. The electric pump according to claim 4, wherein a height of the first rib in a direction of a plane of the attachment surface is higher on the attachment plate portion's side of the electric pump than on the other side of the electric pump further away from the attachment plate portion.

6. The electric pump according to claim 5, wherein the pump cover further includes a second rib that protrudes in a plate shape from the attachment plate portion in a direction along the attachment surface.

7. The electric pump according to claim 6, wherein the pump cover further includes a coupling member that couples the pump cover to another member positioned on the second side with respect to the first side in the axial direction, and a third rib that protrudes in a plate shape from the attachment plate portion in a direction of connecting the coupling member to the fixing location.

8. The electric pump according to claim 1, wherein the pump cover further includes an attachment plate portion that protrudes in a plate shape toward the first side in the axial direction, and has the attachment surface, a plurality of coupling members that couple the pump cover to another member positioned on the other side with respect to the first side in the axial direction, and a fourth rib that protrudes in a plate shape toward the first side in the axial direction, and extends in a direction of connecting the coupling members.

9. The electric pump according to claim 1, wherein the pump cover further includes an attachment plate portion that protrudes in a plate shape toward the first side in the axial direction, and has the attachment surface, a plurality of coupling members that couple the pump cover to another member positioned on the other side with respect to the first side in the axial direction, and a fifth rib that protrudes in a plate shape toward the first side in the axial direction, and extends in a circumferential direction around the drive shaft and a direction of connecting the coupling members.

10. The electric pump according to claim 1, wherein the pump cover further includes an attachment plate portion that protrudes in a plate shape toward the first side in the axial direction, and has the attachment surface, and a sixth rib that protrudes in a plate shape toward the first side in the axial direction, and extends from the attachment plate portion toward a direction along the attachment surface.

11. The electric pump according to claim 1, wherein the opening locations of the first flow path and the second flow path on the attachment surface are displaced from each other in a direction intersecting with the axial direction on the attachment surface.

12. The electric pump according to claim 1, wherein the fixing location is a bottomed recess portion that is opened to the attachment surface, and the bottomed recess portion extends toward the first flow path and the second flow path in the pump cover.

13. An electric pump comprising:

a motor unit that includes a drive shaft, and configured to rotationally drive the drive shaft; and a pump unit that is positioned on a first side in an axial direction along the drive shaft with respect to the motor unit, and configured to suck and discharge a fluid, wherein the pump unit includes a pump rotor configured to send the fluid from a suction side to a discharge side by rotating by a driving force of the drive shaft, and a pump cover disposed at an outer end of the first side in the axial direction so as to cover the pump rotor, the pump cover includes an attachment surface that extends in the axial direction, a first flow path and a second flow path in which the fluid flows, one flow path is on the suction side and the other flow path is on the discharge side, and a fixing location that is engaged with a fixing member within a range of a flange portion of the motor housing as viewed in the axial direction, and all opening locations of the first flow path and the second flow path and the fixing location on the attachment surface are positioned on one side of the drive shaft as viewed in the axial direction, and displaced from one another in the axial direction on the attachment surface.

14. The electric pump according to claim 13, wherein the opening locations of the first flow path and the second flow path on the attachment surface are displaced from each other in a direction intersecting with the axial direction on the attachment surface.

15. The electric pump according to claim 13, wherein the fixing location is a bottomed recess portion that is opened to the attachment surface, and the bottomed recess portion extends toward the first flow path and the second flow path in the pump cover.

* * * * *